US005590748A

United States Patent [19]

Chang

[11] Patent Number: 5,590,748

[45] Date of Patent: Jan. 7, 1997

[54] COLLAPSIBLE HANDLE FOR A WHEELED SUITCASE

[76] Inventor: Jui M. Chang, 2F, 903, Shiang Sin South Road., Taichung, Taiwan

[21] Appl. No.: 407,590

[22] Filed: Mar. 20, 1995

[51] Int. Cl.[6] ..... A45C 5/14; A45C 13/28

[52] U.S. Cl. ..... 190/18 A; 190/39; 190/115; 16/115

[58] Field of Search ..... 280/37, 655, 655.1; 16/115; 190/18 A, 127, 115, 117

[56] References Cited

U.S. PATENT DOCUMENTS 4,616,379 10/1986 Lio ..... 190/117 X
5,253,739 10/1993 King ..... 190/18 A
5,374,073 12/1994 Hung-Hsin ..... 190/18 A X

*Primary Examiner*—Sue A. Weaver

[57] ABSTRACT

A collapsible handle for a wheeled suitcase includes a bottom board disposed on a bottom of the suitcase, the bottom board having a first end and a second end, the first end thereof having a first wall extending upwardly therefrom and two openings defined in the first wall and two passages defined in an upper surface thereof, the passage communicating with the respective opening, a limit element disposed on the lower surface of the first end of the bottom board and two wheels disposed to the lower surface of the second end of the bottom board, a U-shaped handle having two legs slidably received to the two passages via the two openings, each leg having a head formed at a distal end thereof and the head having a flexible protrusion extending laterally from opposite sides thereof so as to be received in two corresponding engaging recesses respectively defined in two side walls defining the passage when the legs are completely received in the suitcase and, the handle is extended out from the openings and is stopped by the head contacting against an end of the limit element.

2 Claims, 4 Drawing Sheets

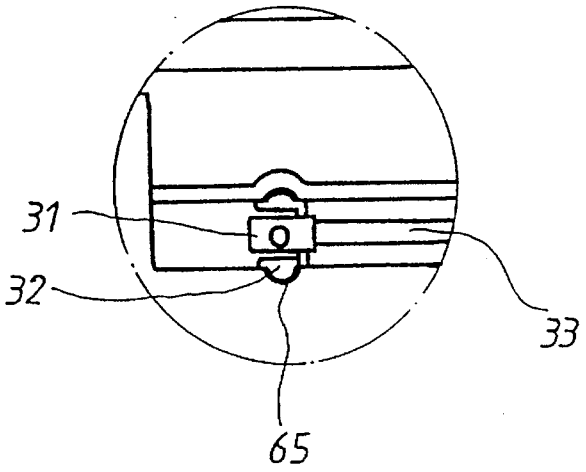
FIG,3
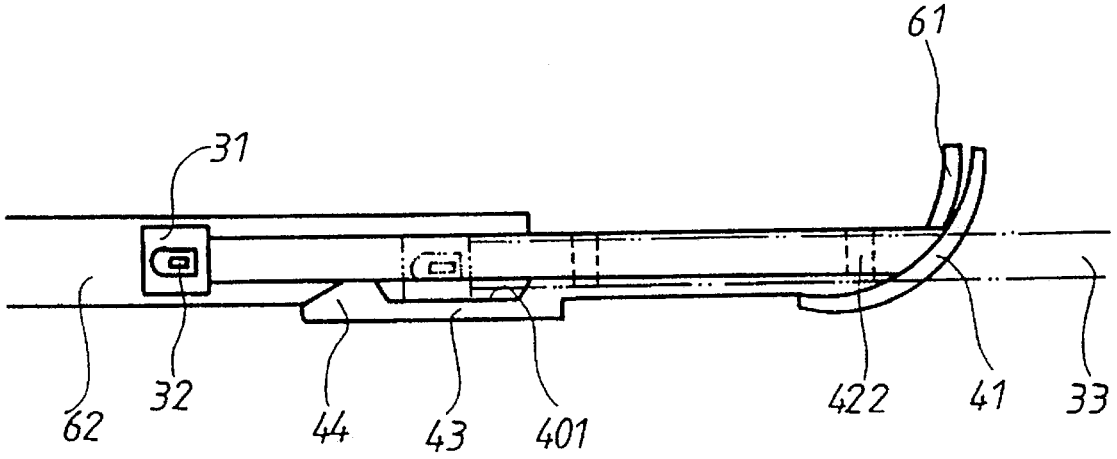
FIG,4

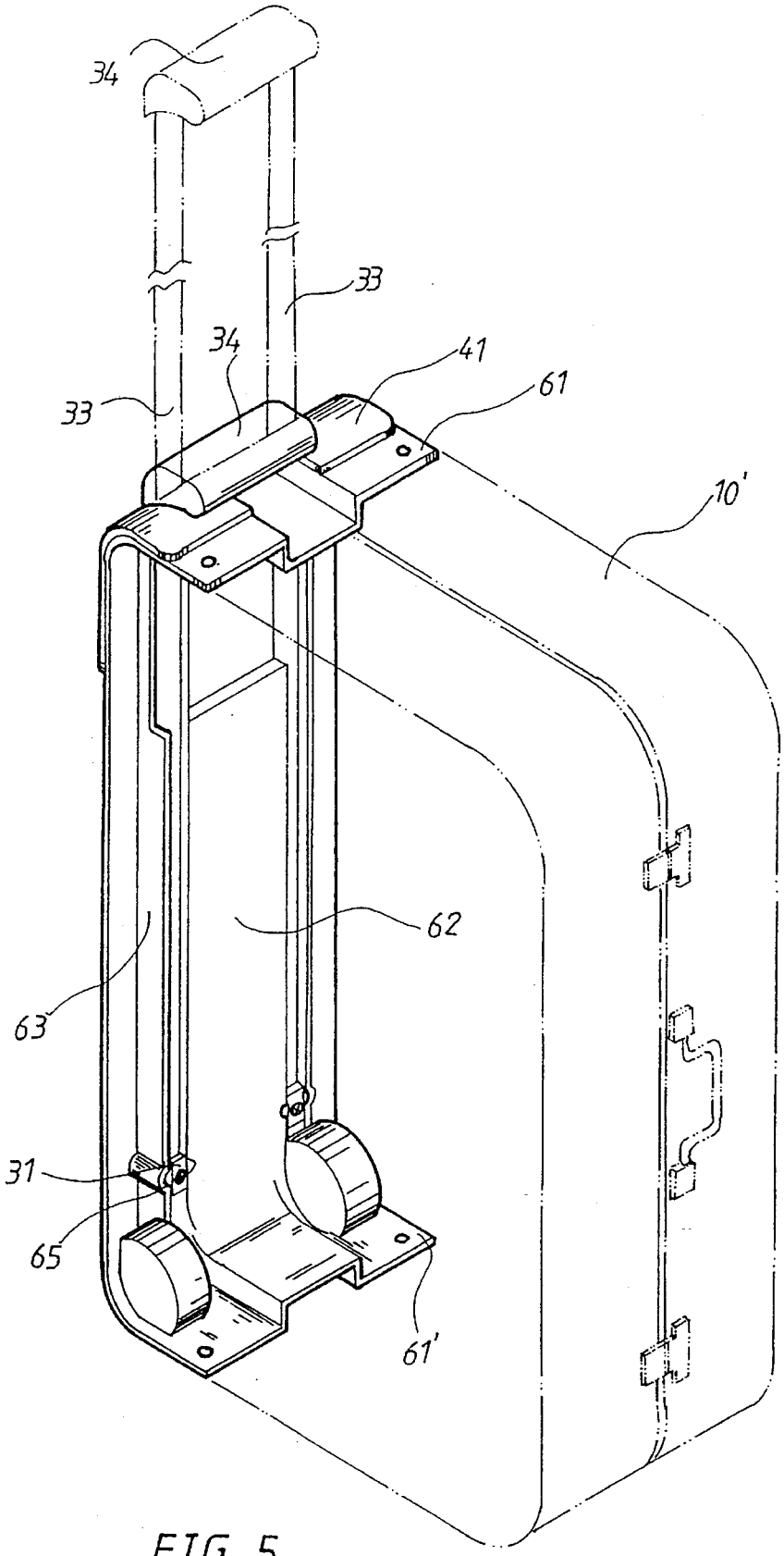
FIG, 5

COLLAPSIBLE HANDLE FOR A WHEELED SUITCASE

BACKGROUND OF THE INVENTION

The present invention relates to a collapsible handle and more particularly, to a collapsible handle for a wheeled suitcase.

A conventional collapsible handle for a wheeled suitcase is shown in FIG. 1. The suitcase 10 has a bottom board 15 which has a first end and a second end, the first end thereof has a first bracket 16 disposed thereto, the first bracket 16 has a wheel 161 rotatably engaged to each ends of the bottom board 15, the second end thereof has a second bracket 17 disposed thereto, the second bracket 17 has an extension part 171 extending from each thereof and each of the extension parts 171 has a hole defined therein, for a tube 11 extending therethrough and engaged to the first bracket 16, A U-shaped handle 12 has a handle portion 122 and the handle portion 122 has two legs 121 separately extending therefrom, each of the legs 121 is slidably received in the tube 11 via the hole of the extension part 171, Each of the extension parts 171 has two lugs 172 extending laterally therefrom between which an opening (not shown) is defined and the opening communicates with the hole of the extension part 171. An eccentric element 14 is rotatably engaged between the two lugs 172 and has an operation bar 13 extending therefrom such that when a user wants to extend the handle 12 outwardly form the tubes 11, he/she may rotate the operation bar 13 to rotate the eccentric element 14 to be separated from the leg 21 via the opening, and when he/she wants to fix the handle 12 in position, just to rotate the eccentric element 14 to a position opposite to the direction for pulling the handle 12 to contact against the leg 121 via the opening.

However, when the user operates the operation bar 13 with one hand he/she must hold the handle 12 with his/her other hand and this is not .convenient for the user to operate the collapsible handle when there are some other goods to be held. Furthermore, the eccentric element 14 could be damaged when it is used to contact against the leg 12 frequently.

The present invention intends to provide a collapsible handle for a wheeled suitcase, which collapsible handle can be operated by only one hand so as to mitigate and/or obviate the above-mentioned problems.

SUMMARY OF THE INVENTION

The present invention provides a collapsible handle for a wheeled suitcase and which includes a bottom board disposed to a bottom of the suitcase, the bottom board having a first wall extending upwardly therefrom two openings defined in the first wall and two passages defined in an upper surface of the bottom board, each of the passages communicating with the respective opening, two wheels disposed to a second end of the bottom board, a U-shaped handle having two legs which are slidably received to the two passages via the two openings, each of the legs has a head formed thereto, the head having a flexible protrusion extending laterally from opposite sides thereof to be received in two corresponding engaging recesses respectively defined in two side walls defining the passage when the legs are completely received in the suitcase, a limit element disposed to a bottom of the first end of the bottom board and such that the legs are pulled out from the openings and are stopped by contacting against the end of the limit element to be positioned.

It is an object of the present invention to provide a collapsible handle having a handle which is able to be operated by only one hand.

Other objects, advantages, and novel features of the invention will become more apparent from the following detailed description when taken in conjunction with the accompanying drawings.

BRIEF DESCRIPTION OF THE DRAWINGS

FIG. 3 is a top plane view which shows two protrusions of the head of the legs are received in the engaging recesses of the bottom board when the handle is received in the suitcase;

FIG. 4 is a side elevational view which shows the head of the handle slidably moved over a block of the limit element when the handle is pulled; and FIG. 5 is a perspective view of the lugging device disposed on a suitcase (shown in phantom lines) wherein the handle pulled upwardly is shown in phantom lines.

DETAILED DESCRIPTION OF THE PREFERRED EMBODIMENT

Figure 1:
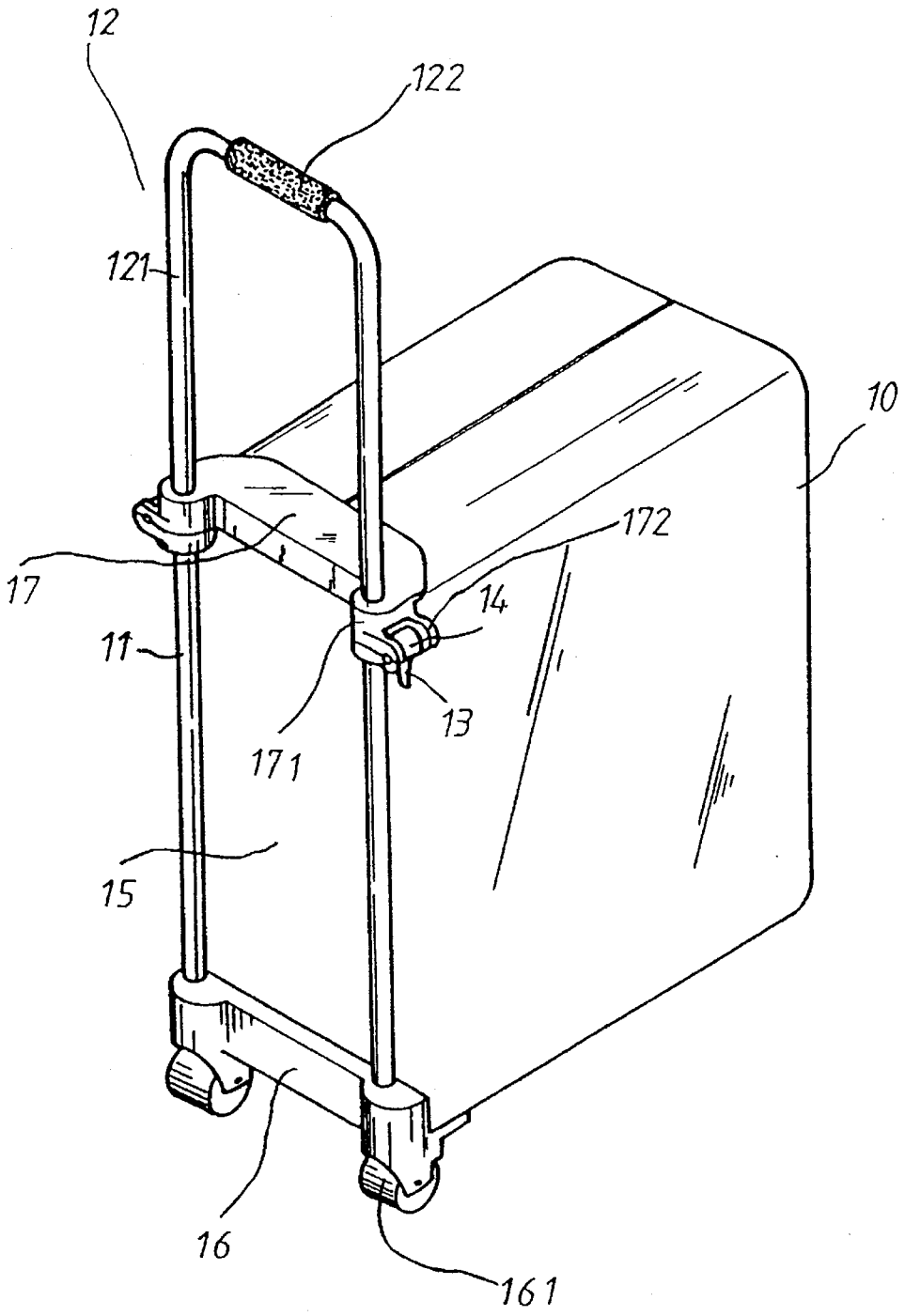
FIG. 1 PRIOR ART
FIG. 1 is a perspective view of a conventional collapsible handle disposed on a bottom of a suitcase.
Figure 2:
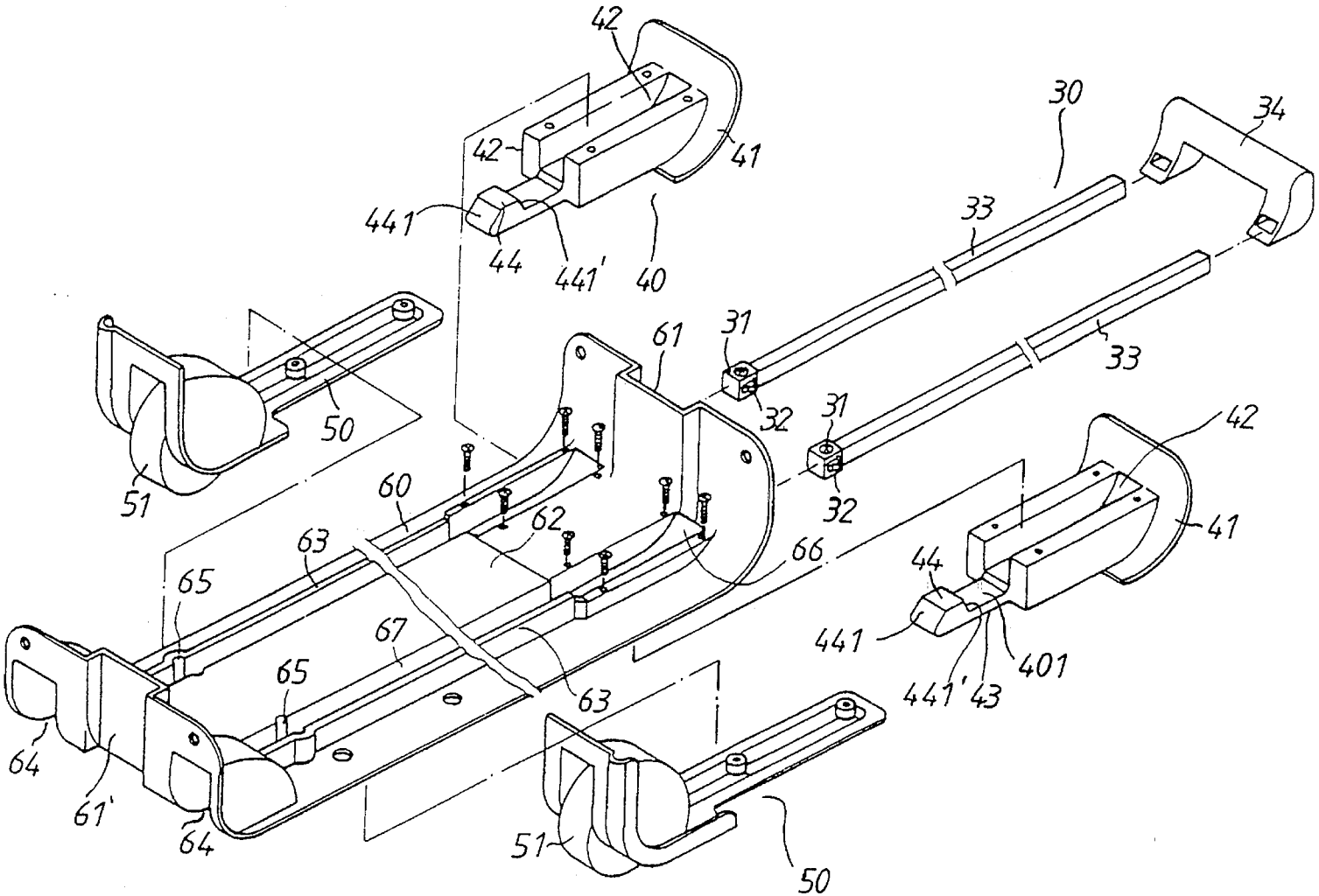
FIG. 2 is an exploded view of a collapsible handle in accordance with the present invention.

Referring to the drawings and initially to FIGS. 2 and 5, a collapsible handle in accordance with the present invention generally includes a bottom board 60 disposed on a bottom of a suitcase 10', the bottom board 60 having a first end and a second end, the first end thereof having a first wall 61 integrally extending upwardly therefrom, the first wall 61 having two openings 66 defined in a lower portion thereof, the second end thereof having a second wall 61' integrally extending upwardly therefrom and the second wall 61' having two recesses 64 defined in a lower surface thereof, The bottom board 60 has a protrusion 62 and two side walls 63, extending upwardly from an upper surface thereof from the first wall 61 to the second wall 61', the protrusion 62 located between the two side walls 63 and each of the side walls 63 and the protrusion 62 having a passage 67 defined therebetween and the passage positioned such that it communicates with the corresponding opening 66. Each of the side walls 63 and two sides of the protrusion 62 have an engaging recesses 65 defined therein and communicating with the passage 67 near the second wall 61'.

A handle 30 being a U-shaped element comprises a handle portion 34 from which two legs 33 extend separately, each of the two legs 33 having a head 31 formed at a distal end thereof, the head 31 having two protrusions 32 flexibly extending from two opposite sides thereof and each of the protrusions 32 can be received in the corresponding engaging recess 65 when the legs. 33 are received in the passage 67 of the suitcase 10'.

A limit element 40 is disposed on the lower surface of the first end of the bottom board 60 and has a U-shaped cross section with a first end and a second end, the first end thereof having an end plate 41 which has a hole 42 defined therein and is aligned with the opening 66, the second end thereof having a tongue 43 extending therefrom into the passage 67, the tongue 43 has a block 44 extending upwardly therefrom, the block 44 having two inclined surfaces 441, 441' formed on opposite sides along a longitudinal direction of the tongue 43. A receiving portion 401 is defined between the block 44 and the second end of the U-shaped limit element 40 for the head 31 of each of the legs 33 received therein when the legs 33 are pulled completely, and the head 31 has a wider width than that of the second end of the U-shaped limit element 40.

A wheel case 50 is disposed on the lower surface of the second end of the bottom board 60 [and corresponds to the passage 67], the wheel case 50 has a first end and a second end, the second end thereof has a wheel 51 rotatably engaged therein and is received in the recess 64 of the second wall 61'.

Referring now to FIGS. 3 and 4, the leg 33 is inserted into the passage 67 via the opening 66 to arrange the protrusions 32 of the head 31 to be received in the engaging recesses 65 of the protrusion 62 and the side wall 63 such that the handle 30 is positioned. When the handle 30 is extended out by pulling the handle portion 34, the flexible protrusions 32 are moved out from the engaging recesses 65 and then the head 31 is moved over the block 44 of the limit element 40 by sliding over the inclined surfaces 441 to be disposed in the receiving portion 401 and contacts against the second end of the limit element 40, therefore, the suitcase 10' can be pulled by pulling the handle 30. When the handle 30 is to be received into the suitcase 10', the user just pushes the handle portion 34 toward the second end of the bottom board 60 to push the head 31 to slide over the inclined surfaces 441' till the protrusions 32 are received in the engaging recesses 65 again.

Accordingly, the collapsible handle in accordance with the present invention is operated by only one hand and has a feature of positioning the handle 30 in the suitcase 10'.

Although the invention has been explained in relation to its preferred embodiment, it is to be understood that many other possible modifications and variations can be made without departing from the spirit and scope of the invention as hereinafter claimed.

I claim:

1. A collapsible handle for a wheeled suitcase and comprising:

a bottom board disposed on a bottom of said suitcase, said bottom board having a first end and a second end, said first end thereof having a first wall extending upwardly therefrom, said first wall having at least one opening defined therein, said second end thereof having a second wall extending upwardly therefrom, said bottom board having at least one recess defined in a lower surface adjacent said second wall thereof, a protrusion and a side wall extending upwardly and separately from an upper surface of said bottom board from said first wall to said second wall and a passage defined between said protrusion and said side wall, said passage positioned such that said passage communicates with said opening, each of said protrusion and said side wall having an engaging recess formed in a side thereof defining said passage near said second wall;

a handle being a U-shaped element and comprising a handle portion from which at least one leg extends, said leg having a head disposed at a distal end thereof, said head having at least one protrusion flexibly extending from a side thereof and corresponding to said one of said engaging recesses such that said protrusion is received in one of said engaging recesses when said leg is completely received in said passage;

a limit element having a U-shaped cross section and being disposed on said lower surface of said first end of said bottom board and having a first end and a second end, said first end thereof having an end plate, said end plate having a hole defined therein and aligned with said opening, said second end thereof having a tongue extending therefrom into said passage, said tongue having a block extending from an upper surface thereof and said block having two inclined surfaces formed on opposite sides along a longitudinal direction of said tongue; and a wheel case disposed on said lower surface of said second end of said bottom board and having a first end and a second end, said second end thereof having a wheel rotatably engaged therein and said wheel received in said recess of said second wall.

2. The collapsible handle as claimed in claim 1 wherein a receiving portion is defined between said block and said second end of said U-shaped limit element dimensioned for said head of said leg received therein when said leg is completely extended, said head having a wider width than that of said second end of said U-shaped limit element.

* * * * *